US006657524B2

(12) United States Patent
Bach et al.

(10) Patent No.: US 6,657,524 B2
(45) Date of Patent: Dec. 2, 2003

(54) CIRCUIT BREAKER WITH A DETACHABLE CONNECTION BETWEEN A SWITCHING CONTACT ARRANGEMENT AND A DRIVE APPARATUS WHICH OPERATES IT, AS WELL AS A METHOD FOR REMOVAL AND INSTALLATION OF THE SWITCHING CONTACT ARRANGEMENT

(75) Inventors: Michael Bach, Berlin (DE); Detlev Schmidt, Berlin (DE); Guenter Seidler-Stahl, Berlin (DE); Ingo Thiede, Berlin (DE); Sezai Tuerkmen, Berlin (DE); Artur Wajnberg, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/222,580

(22) Filed: Aug. 19, 2002

(65) Prior Publication Data

US 2003/0057067 A1 Mar. 27, 2003

(30) Foreign Application Priority Data

Sep. 3, 2001 (DE) ..... 101 44 106

(51) Int. Cl.[7] ..... H01H 33/04; H01H 3/46; H01H 67/02

(52) U.S. Cl. ..... 335/6; 335/132; 335/189; 335/202; 200/281; 200/303

(58) Field of Search ..... 335/6, 8–17, 21–27, 335/132, 189, 202; 200/281, 303, 564

(56) References Cited

U.S. PATENT DOCUMENTS

| | | | | |
|---|---|---|---|---|
| 4,679,016 A | * | 7/1987 | Ciarcia et al. | 335/132 |
| 4,764,650 A | | 8/1988 | Bur et al. | 200/153 |
| 4,884,047 A | * | 11/1989 | Baginski et al. | 335/10 |
| 5,847,340 A | | 12/1998 | Godesa | 200/50.32 |

FOREIGN PATENT DOCUMENTS

| | | |
|---|---|---|
| DE | 296 08 061 U1 | 3/1997 |
| DE | 196 37 678 A1 | 3/1998 |
| EP | 225 207 B1 | 6/1987 |
| EP | 789 925 B1 | 8/1997 |

* cited by examiner

*Primary Examiner*—Ramon M. Barrera
(74) *Attorney, Agent, or Firm*—Harness, Dickey & Pierce, P.L.C.

(57) ABSTRACT

A circuit breaker includes a switching contact arrangement and a drive apparatus which operates it, with the connection between the switching contact arrangement and the drive apparatus being designed such that it is detachable. For this purpose, a contact support of the switching contact arrangement contains a coupling bolt, which produces a hinged connection to a lever arrangement for the drive apparatus. A holding piece allows a actuating shaft of the drive apparatus to be rotated to a position, and to be fixed in this position. This allows the switching contact arrangement to be removed without any problem, and subsequently to be replaced by another switching contact arrangement. Once the control panel for the circuit breaker has been removed, the holding piece can be placed on the actuating shaft and can be attached to a front housing body of the circuit breaker where the control panel would otherwise be located.

15 Claims, 4 Drawing Sheets

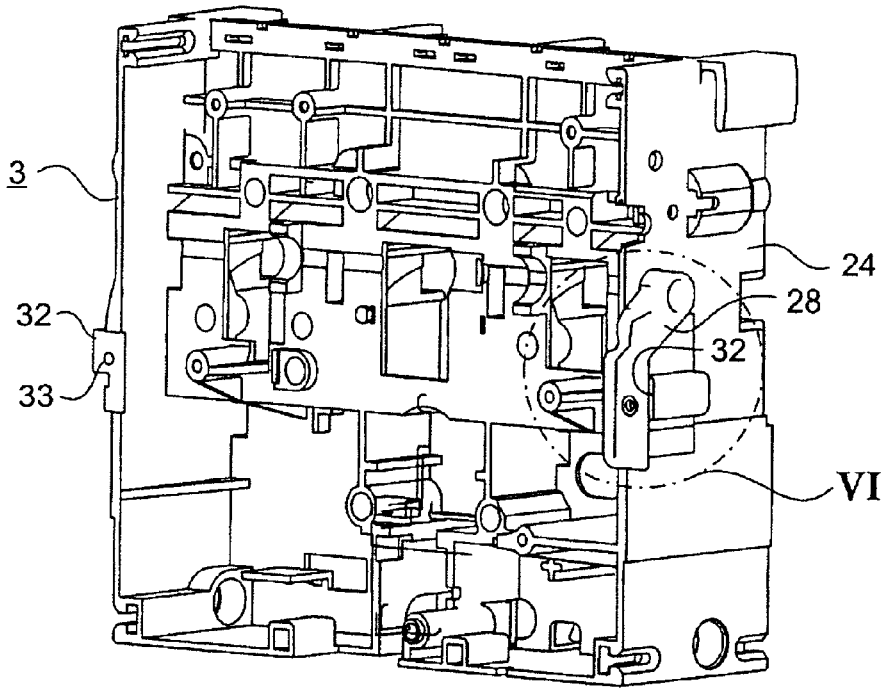
FIG 5
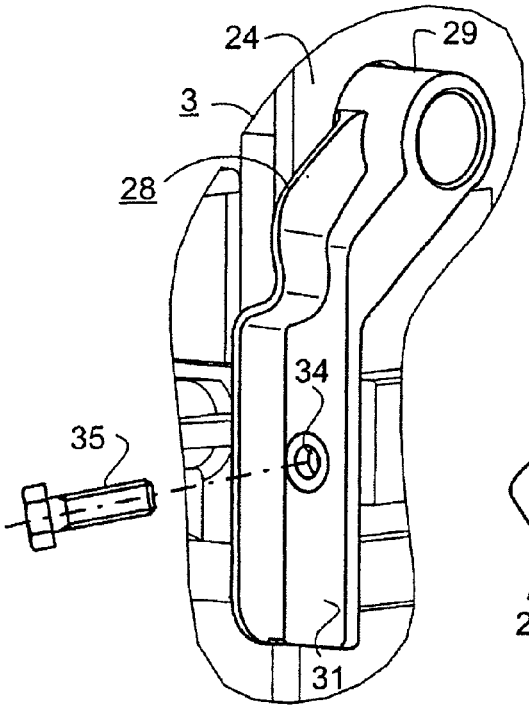
FIG 6 (VI)
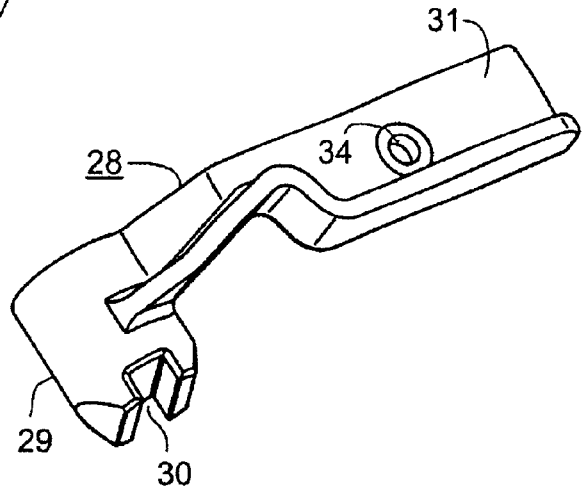
FIG 7

CIRCUIT BREAKER WITH A DETACHABLE CONNECTION BETWEEN A SWITCHING CONTACT ARRANGEMENT AND A DRIVE APPARATUS WHICH OPERATES IT, AS WELL AS A METHOD FOR REMOVAL AND INSTALLATION OF THE SWITCHING CONTACT ARRANGEMENT

The present application hereby claims priority under 35 U.S.C. §119 on German patent publication number DE 10144106.1 filed Sep. 3, 2001, the entire contents of which are hereby incorporated by reference.

FIELD OF THE INVENTION

The invention generally relates to an electrical circuit breaker having a detachable connection between a switching contact arrangement and a actuating shaft which operates it. Preferably, the switching contact arrangement is held between two housing bodies, which can be separated from one another, of the circuit breaker. Furthermore, a coupling bolt, which is preferably held in a contact support of the switching contact arrangement, preferably engages in a lever arrangement, which is connected to the actuating shaft.

BACKGROUND OF THE INVENTION

Circuit breakers are described, for example, in DE 196 37 678 A1, DE 296 08 061 U1 or EP 0 225 207 B1. Circuit breakers are designed for a long life, by virtue of their use in power supply systems and by virtue of the requirements for high reliability that exist here. For example, loading with high switching ratings, for example when interrupting short-circuit currents, does not lead to the entire circuit breaker, but only to specific components, being completely worn out or becoming unusable. These include, in particular, all the components of the switching contact arrangements, since these are subject directly to the high energy of switching arcs, whose influence results in the contact material being worn away or being lost. The detachable connection between the switching contact arrangements and the drive apparatus which operates it allows only the worn-away switching contact arrangement to be replaced, while all the other components in the circuit breaker can still be used.

The detachable connection which has been mentioned between the switching contact arrangement and the associated drive apparatus is generally designed such that a coupling bolt is arranged in a movable contact support in the switching contact arrangement, and connects the contact support in a hinged manner to the lever arrangement which has been mentioned. Suitable configuration of the contact support and/or of the coupling bolt allows the coupling bolt to be moved or to be removed using commercially available tools, once they have been made accessible, for example by removing arcing chambers or other parts of the circuit breaker that cover the switching contact arrangement.

Once the housing bodies have been disconnected, the switching contact arrangement can then be removed completely, so that all the live parts of the main current path in the circuit breaker are accessible. These are, firstly, a lower busbar, which is generally connected to one or more movable contact levers via flexible conductors which cannot be disconnected, and whose end which projects to the rear out of the housing body forms an external connection for the circuit breaker. There is also an upper busbar, which interacts with the contact levers and in the same way forms a connection for the circuit breaker.

When these parts are replaced, the connection for the lever arrangement must then be made once again. This requires the lever arrangement to be in a specific position, which in turns depends on the position of the actuating shaft. However, for its part, this cannot be rotated without any restrictions, since it is connected to latching parts of the drive apparatus. This leads to the difficulty that the actuating shaft may be located in the ON position after the switching contact arrangement has been replaced, so that the rearward housing body of the circuit breaker, through which the busbars extend, cannot be connected to the associated front housing body without exerting force. This is because this would necessitate applying a load to all the contact force springs of the switching contact arrangements (depending on the configuration of the circuit breaker 3 or 4).

Since this is impractical, the only possible option is to move the actuating shaft to its disconnected position. To do this, it is necessary to operate latching parts, which are located in the drive apparatus by hand and to move further mechanical elements temporarily to a specific position. One precondition for this is that access is first of all created to the relevant assemblies of the drive apparatus by removing a number of assemblies from the circuit breaker. This work is time-consuming and requires detailed knowledge about the design of the relevant circuit breaker. Thus, in general, switching contact arrangements can be replaced only by specially trained specialists in a special workshop.

SUMMARY OF THE INVENTION

An embodiment of the invention is based on an object of considerably simplifying the replacement of a switching contact arrangement and, in particular, of restricting this to steps which can also be carried out by the user of the circuit breaker.

According to an embodiment of the invention, an object may be achieved in that a holding piece is provided for fixing the actuating shaft in a position which is suitable for disconnection and for renewed connection to the contact support. If the angular position of the actuating shaft is chosen in a suitable manner, this allows operation without application of any force, and without any manipulation of or actions on the latching devices of the drive apparatus. Since, furthermore, no access is required to the drive apparatus either, there is no need for the previously required steps of removing and reinstalling assemblies which are adjacent to the drive apparatus.

For the purposes of an embodiment of the invention, it has been found to be advantageous for the holding piece to be in the form of a handle lever and to have a coupling member for rotationally locked coupling to the actuating shaft. In this embodiment the holding piece can be used easily by the user, provided the actuating shaft of the circuit breaker is designed in a known manner such that it can itself be coupled. One example of this is illustrated in FIG. 5 of EP 0 789 925 B1.

If, at the same time, it can be assumed that there is no need to exert a large amount of force to move the actuating shaft to the position which is suitable for replacement of switching contact arrangement, it is recommended that the holding piece be provided with a handle part, which is used to exert a torque on the actuating shaft; and it is recommended that an aperture opening be provided, which passes through the handle part, for holding an attachment means which fixes the holding piece in an end position.

The handle part with the aperture opening can advantageously be used in particular in a circuit breaker which has a control panel which covers the front of the drive apparatus and can be detachably attached to a front housing body. This is because the contact surface and holding openings for an attachment device for the control panel are accessible once the control panel has been removed from the circuit breaker. If the holding piece is now designed such that, in its end position, its handle part rests on a contact surface, which is provided for the control panel, on the front housing body and the aperture opening corresponds to a holding opening, which is located on the contact surface, for the attachment device for the control panel, then the user can easily fix the holding piece.

If any or all of the configurations described above are implemented, then these allow a procedure sequence for replacement of a switching contact arrangement which is advantageously shorter than that for the previous procedures:

a) removal of the control panel of the circuit breaker,
b) fitting of the holding piece to the actuating shaft and rotation of the actuating shaft to a predetermined end position,
c) attachment of the holding piece for maintaining the end position,
d) releasing the attachment means in order to disconnect the housing bodies which hold the switching contact arrangement,
e) releasing the connection between the contact support and the lever arrangement,
f) removal of the switching contact arrangement and insertion of another switching contact arrangement,
g) making the connection between the lever arrangement and the contact support,
h) joining the housing bodies and insertion of the associated attachment means,
i) removal of the holding piece,
k) fitting of the control panel.

BRIEF DESCRIPTION OF THE DRAWINGS

The invention will be explained in more detail in the following text, with reference to the exemplary embodiment which is illustrated in the figures.

FIG. 5 shows a front housing body for the circuit breaker as shown in FIG. 1, with assemblies removed and with a holding piece fitted at the side for a actuating shaft.

FIG. 6 shows the fitting of the holding piece, in the form of an enlarged detail.

FIG. 7 shows the holding piece as an individual part, illustrated in perspective.

DETAILED DESCRIPTION OF THE PREFERRED EMBODIMENTS

Figure 1:
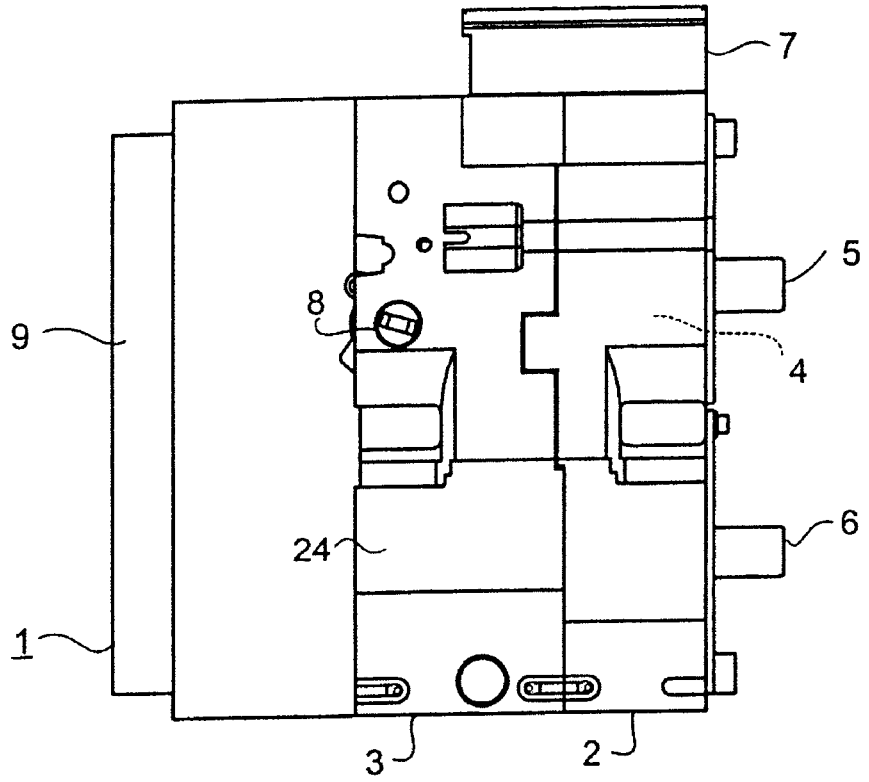
FIG. 1 shows, in simplified form, a side view of a low-voltage circuit breaker.

The general features of a low-voltage circuit breaker that is covered by the scope of the invention will be explained first of all, with reference to an embodiment shown in FIG. 1. The circuit breaker 1 has a rear housing body 2, in the form of a rear wall, as well as a front housing body 3, which is connected to the housing body 2. A switching contact arrangement 4, which cannot be seen in FIG. 1, is held between the housing bodies 2 and 3 and has an upper busbar 5 and a lower busbar 6, which are used to connect the main current part of the circuit breaker 1 to an external circuit. The circuit breaker 1 may be designed, in a known manner, to have a number of poles and, accordingly, to contain a number of switching contact arrangements 4. The housing body 3 is in the form of a support for the mechanical and electronic assemblies. These include, in particular, a drive apparatus, which interacts with the switching contact arrangement 4, or with a number of such switching contact arrangements, by means of a actuating shaft 8, which is accessible on at least one side wall of the housing body 3. At the front, the housing body 3 is covered by a control panel 9, on which all the operating, control and adjustment members that are essential for the user are arranged.

Figure 2:
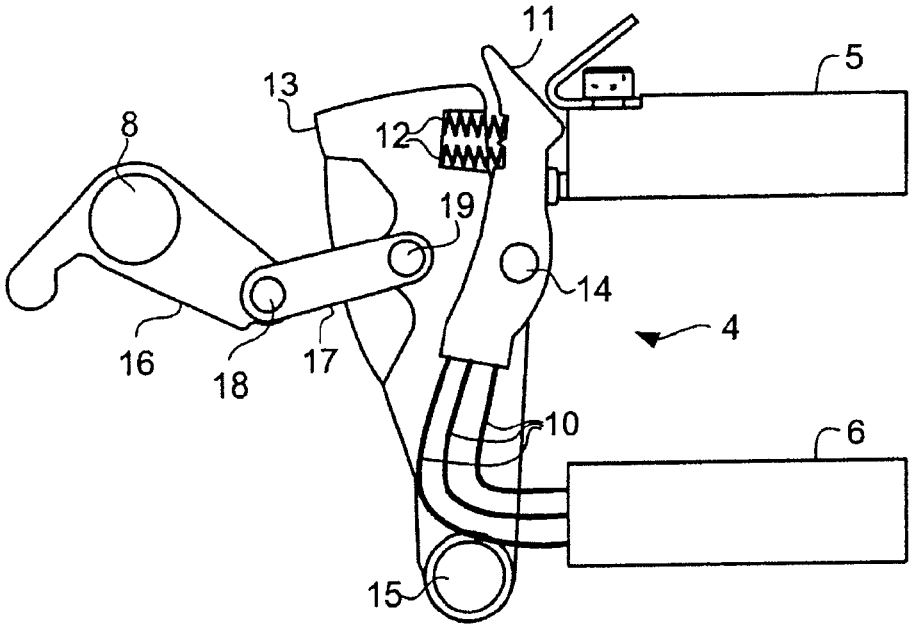
FIG. 2 shows a switching contact arrangement for the circuit breaker shown in FIG. 1.

FIG. 2 shows the basic design of the switching contact arrangement 4. As can be seen, a contact lever 11 is connected to the lower connecting rail 6 by means of flexible conductors 10 and makes contact with the upper busbar 5 when the switching contact arrangement is in the closed position. In this case, contact force springs 12 which are located in a recess in a contact support 13 that holds the contact lever 11 provide a contact force which ensures reliable current transfer. The contact lever 11 is mounted on the contact support 13 by means of a bearing bolt 14, such that it can pivot. The contact support 13 can itself pivot about a bearing journal 15, with the pivoting bearing which is formed in this way being located close to the inner end-face of the lower busbar 6. As is known per se, a large number of contact levers 11 can be arranged parallel to one another, on a common beating bolt 14 in one contact support 13. The busbars 5 and 6 have correspondingly designed widths, and have contact surfaces and switching pieces for all the contact levers.

The contact support 13 can be operated by a lever arrangement via the actuating shaft 8 that has been mentioned, in order to allow the contact levers 11 to be moved from the illustrated connected position to a disconnected position. The lever arrangement has one or more drive levers 16 as well as coupling lugs 17, which are seated on the actuating shaft 8. These are connected firstly by a hinge bolt 18 to the drive lever 16 and secondly by a coupling bolt 19 to the contact support 13. It is also possible to provide a number of coupling lugs 17 arranged parallel to one another, in order to ensure symmetrical force transmission. In order to move the switching contact arrangement to its disconnected position, the actuating shaft 8 is rotated counterclockwise, as a result of which the drive lever 16 pulls the coupling lugs 17 to the left, and in consequence pivots the contact support 13 counterclockwise about its bearing journal 15.

Figure 3:
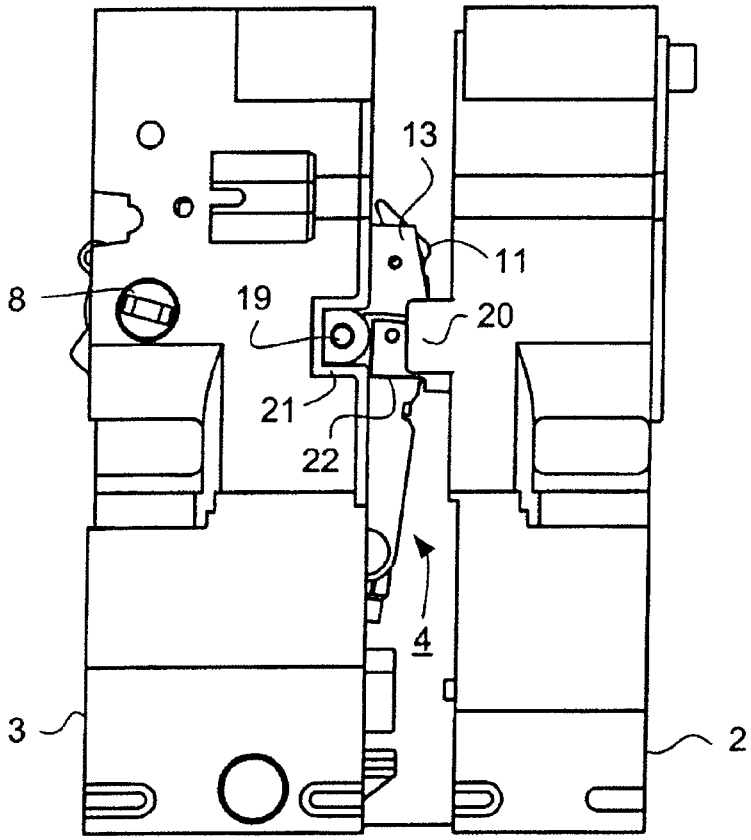
FIG. 3 shows two housing bodies, which have been disconnected from one another, of the circuit breaker as shown in FIG. 1, and part of a switching contact arrangement which is surrounded by the housing bodies.

The housing bodies 2 and 3 are connected to one another and can be disconnected from one another once the attachment devices have been removed, as is illustrated in FIG. 3. Parts of the switching contact arrangement 4, namely the contact support 13 and contact lever 11, can also be seen in FIG. 3. Lateral projections 20 on the rear housing body 2 and corresponding recesses 21 on the front housing body 3 ensure that the coupling bolt 14 on the contact support 13 is accessible when said housing bodies are disconnected. Lugs or tongues 22 are fit on the housing body 2, in order to simplify the subsequent renewed connection of the housing bodies 2 and 3.

Figure 4:
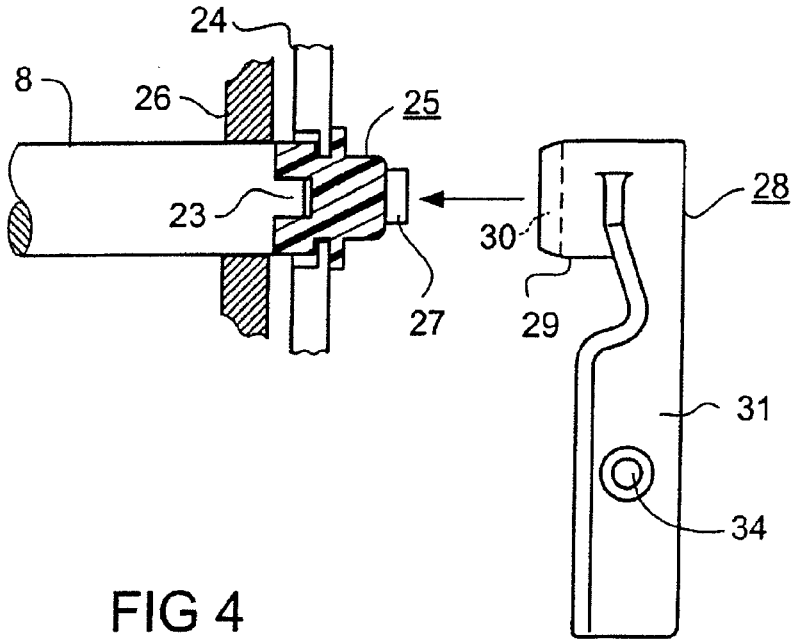
FIG. 4 shows a detail of an arrangement for detachable coupling of a holding piece to a actuating shaft of the circuit breaker as shown in FIG. 1.

FIG. 3 also shows the position of an end-face access to the actuating shaft 8. In a corresponding way to the detail that is shown in FIG. 4, which corresponds for example to the arrangement according to FIG. 5 in EP 0 789 925 B1 (although it is used for different purposes there however), a coupling web 23, which is formed by flattened areas and to which an insulating adapter 25 is fit in a rotationally locked manner, is located close to a bearing 26 at one end of the actuating shaft 8. This insulating adapter 25 projects through a side wall 24 and, on the outside, has a coupling web 27 for a holding piece 28. This has a hub part 29 with a coupling slot 30, which is used as a coupling member. A handle part 31, in which an aperture opening 34 is arranged, originates from the hub part 29. The character and use of the holding piece 28 can be seen in more detail in FIGS. 5, 6 and 7, to which the following text refers.

The use of the adapter 25 is expedient for the connection of the holding piece 28 for the actuating shaft 8, but is not essential since, obviously, the two parts can engage directly via the coupling web 23 and the coupling slot 30. However, the adapter offers the option of, for example, fitting differently shaped coupling elements on the actuating shaft 8 and on the holding piece, and of satisfying further conditions.

FIG. 5 shows the housing body 3, as it is seen by the viewer after removal of the control panel 9 (FIG. 1) and removal of all the assemblies, including the actuating shaft 14. The holding piece 28 is intended to be fit to the right-hand side wall 24 of the housing body 3. A hub part 29, with the coupling slot 30 that has been mentioned, engages, in the position shown in FIG. 5, with the coupling web 23 of the actuating shaft 8 or, when the adapter 25 is provided, with the corresponding coupling web 27 of the adapter 25. The handle part 31 of the holding piece 28 makes it possible for the user first of all to connect the holding piece 28 in the initial position to the actuating shaft 8, and then to rotate it to the intended end position. In this end position, the handle part 31 comes into contact with a contact surface 32 on the side wall 24 of the housing body 3, which is provided for the control panel 9 to make contact with and to be attached to (FIG. 1). For this purpose, the contact surface 32 has a holding opening 33 for an attachment means (screw or the like). The handle part 31 of the holding piece 28 is provided with an aperture opening 34, which corresponds with the holding opening 33 in the contact surface 32 when the holding piece 28 has been moved to its end position. In a corresponding way to FIG. 6, an attachment means 35, for example in the form of the illustrated hexagonal screw, can then be inserted.

Figure 8:
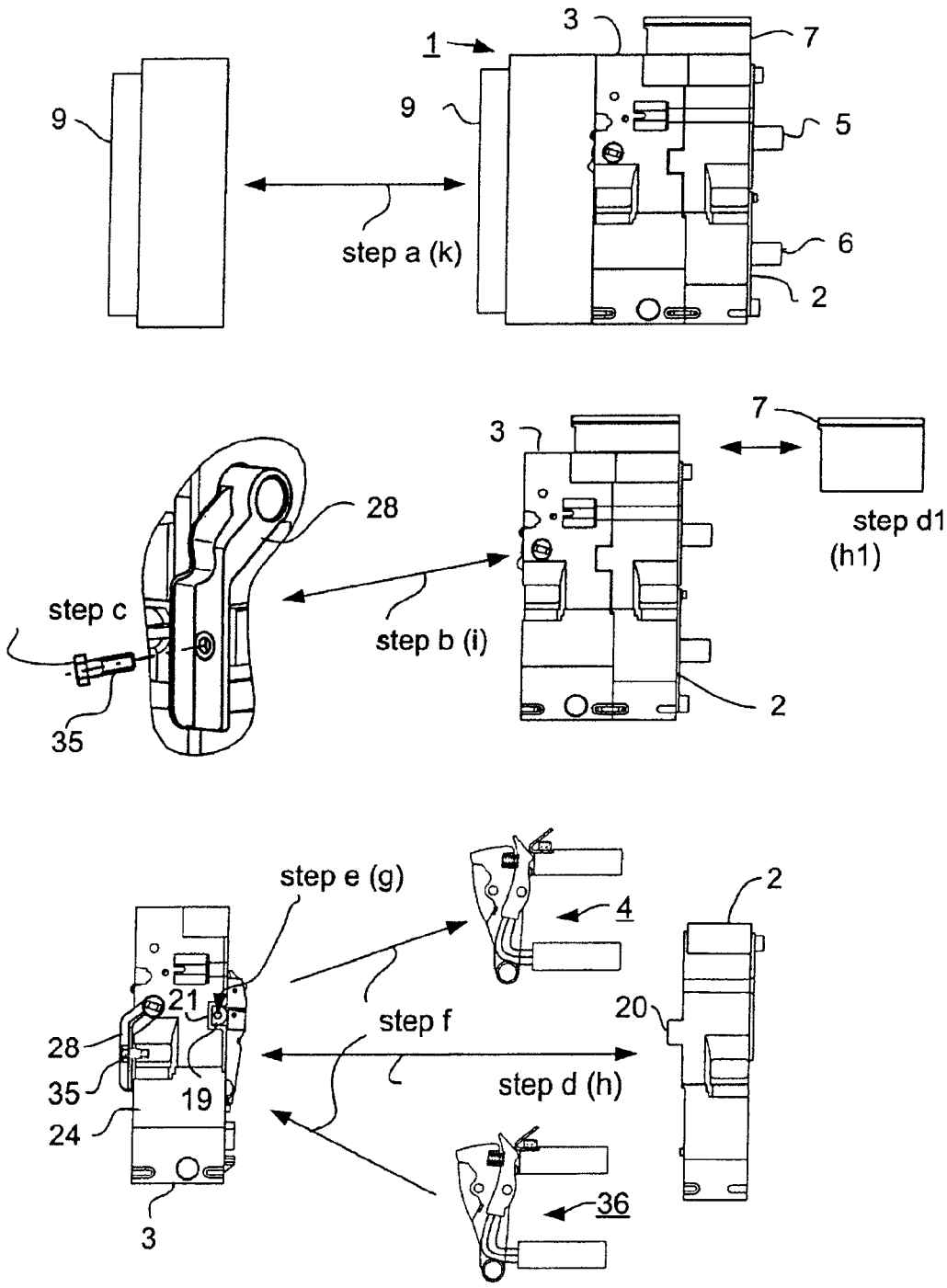
FIG. 8 uses a number of figure elements to show a method for replacement of a switching contact arrangement in a circuit breaker as shown in the preceding figures.

The procedure for replacement of a switching contact arrangement 4 in a circuit breaker 1 as shown in FIG. 1 will now be explained in conjunction with FIG. 8. To the extent that they can be seen in the figure, the individual steps are in this case provided with the same designations (a to k) as those contained in patent claim 5. First of all, the control panel 9 is removed from the circuit breaker 1 in step a, thus, in particular, exposing the contact surfaces 32 for the control panel, which are located on the right-hand side wall 24 of the housing body 3. In the next step b, the holding piece 28 is placed on the actuating shaft 8 in the described manner, in order to move the actuating shaft 8 to an intended end position by operating the handle part 31, with this end position being that which is most suitable for replacement of the switching contact arrangement. This end position is, in particular, an intermediate position of the actuating shaft between OFF and ON, to be precise shortly before load starts to be applied to the contact force springs. In this end position, the handle part 31 rests on the contact surface 32, and the attachment means secures the actuating shaft 8 by means of the holding piece 28 in the relevant position. The attachment means, which connect the housing bodies 2 and 3 to one another, are released in the next step d. This may include, in a known manner, tie rods or foot parts, which extend over both housing parts.

The switching contact arrangement 4 (FIG. 2) with its major components including the contact support 13 with the contact levers 11 as well as the upper busbar 5 and the lower busbar 6 can be removed after carrying out step e, which essentially comprises removal of the coupling bolt 19. With regard to the different arrangements which are known for this purpose, reference is once again made, by way of example, to EP 0 225 207, DE 196 37 678 A1 or DE 269 08 061 U1. In step f, the switching contact arrangement is removed, and is replaced by a new identical switching contact arrangement 36.

The steps g, h, i and k which are then required are used to reproduce the original state and thus represent the reversal of the already explained steps a to e. In order to illustrate this in FIG. 8, the corresponding steps g to k are in each case shown in brackets after the steps a to e.

The above description has not explained in any detail the handling of the quenching chambers 7, whose removal is likewise expedient. This may be done right at the start of the work, for example after removal of the control panel 9 in step a. However, it is sufficient to deal with the quenching chamber 7 before disconnection of the housing bodies 2 and 3, as is illustrated in FIG. 8 as step d1 and as a corresponding step h1 that needs to be carried out during assembly.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An electrical circuit breaker, comprising:

a detachable connection between a switching contact arrangement and a actuating shaft which operates it;

two housing bodies, separable from one another, wherein the switching contact arrangement is held between the two housing bodies;

a coupling bolt, held in a contact support of the switching contact arrangement, engaging in a lever arrangement connected to the actuating shaft; and a holding piece for fixing the actuating shaft in a position which is suitable for disconnection and for renewed connection of the lever arrangement to the contact support.

2. A method for removing and installing a switching contact arrangement of the circuit breaker as claimed in claim 1, comprising the following steps:

a) removing a control panel of the circuit breaker;

b) fitting the holding piece to the actuating shaft and rotating the actuating shaft to a predetermined end position;

c) attaching the holding piece to maintain the end position;

d) disconnecting the housing bodies which hold the switching contact arrangement;

e) releasing the connection between the contact support and the lever arrangement;

f) removing the switching contact arrangement and inserting another switching contact arrangement;

g) making the connection between the lever arrangement and the contact support;

h) joining the housing bodies;

i) removing the holding piece; and k) fitting the control panel.

3. A method for removing a switching contact arrangement of the circuit breaker as claimed in claim 1, comprising the following steps:

a) removing a control panel of the circuit breaker;

b) fitting the holding piece to the actuating shaft and rotating the actuating shaft to a predetermined end position;

c) attaching the holding piece to maintain the end position;

d) disconnecting the housing bodies which hold the switching contact arrangement;

e) releasing the connection between the contact support and the lever arrangement; and f) removing the switching contact arrangement.

4. The circuit breaker as claimed in claim 1, wherein the holding piece is in the form of a handle lever and includes a coupling member for rotationally locked coupling to the actuating shaft.

5. A method for removing and installing a switching contact arrangement of the circuit breaker as claimed in claim 4, comprising the following steps:

a) removing a control panel of the circuit breaker;

b) fitting the holding piece to the actuating shaft and rotating the actuating shaft to a predetermined end position;

c) attaching the holding piece to maintain the end position;

d) disconnecting the housing bodies which hold the switching contact arrangement;

e) releasing the connection between the contact support and the lever arrangement;

f) removing the switching contact arrangement and inserting another switching contact arrangement;

g) making the connection between the lever arrangement and the contact support;

h) joining the housing bodies;

i) removing the holding piece; and k) fitting the control panel.

6. A method for removing a switching contact arrangement of the circuit breaker as claimed in claim 4, comprising the following steps:

a) removing a control panel of the circuit breaker;

b) fitting the holding piece to the actuating shaft and rotating the actuating shaft to a predetermined end position;

c) attaching the holding piece to maintain the end position;

d) disconnecting the housing bodies which hold the switching contact arrangement;

e) releasing the connection between the contact support and the lever arrangement;

f) removing the switching contact arrangement.

7. The circuit breaker as claimed in claim 4, wherein the holding piece includes, a handle part, used to exert a torque on the actuating shaft, and an aperture opening, passing through the handle part, for holding an attachment device which fixes the holding piece in one end position.

8. A method for removing and installing a switching contact arrangement of the circuit breaker as claimed in claim 7, comprising the following steps:

a) removing a control panel of the circuit breaker;

b) fitting the holding piece to the actuating shaft and rotating the actuating shaft to a predetermined end position;

c) attaching the holding piece to maintain the end position;

d) disconnecting the housing bodies which hold the switching contact arrangement;

e) releasing the connection between the contact support and the lever arrangement;

f) removing the switching contact arrangement and inserting another switching contact arrangement;

g) making the connection between the lever arrangement and the contact support;

h) joining the housing bodies;

i) removing the holding piece; and k) fitting the control panel.

9. A method for removing a switching contact arrangement of the circuit breaker as claimed in claim 7, comprising the following steps:

a) removing a control panel of the circuit breaker;

b) fitting the holding piece to the actuating shaft and rotating the actuating shaft to a predetermined end position;

c) attaching the holding piece to maintain the end position;

d) disconnecting the housing bodies which hold the switching contact arrangement;

e) releasing the connection between the contact support and the lever arrangement;

f) removing the switching contact arrangement.

10. The circuit breaker as claimed in claim 7, further comprising:

a control panel, covering and detachably attached to the front of a front housing body, the holding piece being designed such that, in its end position, its handle part rests on a contact surface on the front housing body and is provided for the control panel, and such that the aperture opening corresponds to a holding opening for an attachment device for the control panel.

11. A method for removing and installing a switching contact arrangement of the circuit breaker as claimed in claim 10, comprising the following steps:

a) removing the control panel of the circuit breaker;

b) fitting the holding piece to the actuating shaft and rotating the actuating shaft to a predetermined end position;

c) attaching the holding piece to maintain the end position;

d) disconnecting the housing bodies which hold the switching contact arrangement;

e) releasing the connection between the contact support and the lever arrangement;

f) removing the switching contact arrangement and inserting another switching contact arrangement;

g) making the connection between the lever arrangement and the contact support;

h) joining the housing bodies;

i) removing the holding piece; and k) fitting the control panel.

12. The method of claim 11, wherein the step d) of disconnecting includes releasing the attachment device in order to disconnect the housing bodies.

13. The method of claim 11, wherein the step h) of joining includes inserting an associated attachment device.

14. A method for removing a switching contact arrangement of the circuit breaker as claimed in claim 10, comprising the following steps:

a) removing the control panel of the circuit breaker;

b) fitting the holding piece to the actuating shaft and rotating the actuating shaft to a predetermined end position;

c) attaching the holding piece to maintain the end position;

d) disconnecting the housing bodies which hold the switching contact arrangement;

e) releasing the connection between the contact support and the lever arrangement;

f) removing the switching contact arrangement.

15. The method of claim 14, wherein the step d) of disconnecting includes releasing the attachment device in order to disconnect the housing bodies.

* * * * *